US012140329B2

(12) United States Patent
Minami

(10) Patent No.: US 12,140,329 B2
(45) Date of Patent: Nov. 12, 2024

(54) INSTALLATION ASSISTANCE SYSTEM FOR AIR CONDITIONING DEVICE, INSTALLATION ASSISTANCE DEVICE, AND INSTALLATION ASSISTANCE METHOD

(71) Applicant: DAIKIN INDUSTRIES, LTD., Osaka (JP)

(72) Inventor: Junya Minami, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 18/383,805

(22) Filed: Oct. 25, 2023

(65) Prior Publication Data

US 2024/0060667 A1 Feb. 22, 2024

Related U.S. Application Data

(63) Continuation of application No. PCT/JP2022/006937, filed on Feb. 21, 2022.

(30) Foreign Application Priority Data

Apr. 28, 2021 (JP) ..... 2021-076277

(51) Int. Cl.
*F24F 11/36* (2018.01)
*F24F 11/49* (2018.01)
(Continued)

(52) U.S. Cl.
CPC ..... *F24F 11/36* (2018.01); *F24F 11/49* (2018.01); *F24F 11/52* (2018.01); *F24F 11/88* (2018.01); *F24F 1/0007* (2013.01); *F24F 11/58* (2018.01)

(58) Field of Classification Search
CPC .. F24F 11/36; F24F 11/88; F24F 11/49; F24F 11/52; F24F 11/58; F24F 1/0007; F25B 2313/023
See application file for complete search history.

(56) References Cited

U.S. PATENT DOCUMENTS 5,996,361 A * 12/1999 Bessler ..... F25D 17/065 62/229
2016/0215771 A1* 7/2016 Hu ..... F04B 17/03
(Continued)

FOREIGN PATENT DOCUMENTS

EP 3434997 A2 * 1/2019 ..... F24F 11/36
EP 3 633 277 A1 4/2020
(Continued)

OTHER PUBLICATIONS

International Preliminary Report of corresponding PCT Application No. PCT/JP2022/006937 dated Nov. 9, 2023.
(Continued)

*Primary Examiner* — Nelson J Nieves
(74) *Attorney, Agent, or Firm* — Global IP Counselors, LLP

(57) ABSTRACT

An air conditioning device includes a first indoor unit and a second indoor unit interlocking with a safety device as a countermeasure against refrigerant leakage. An installation assistance system for the air conditioning device determines interlock release states of the first indoor unit and the second indoor unit based on information on the air conditioning device, and outputs a determination result. The information on the air conditioning device is information indicating whether or not the first indoor unit and the second indoor unit are short-circuited with the safety device through an interlock line.

15 Claims, 5 Drawing Sheets

(51) Int. Cl.

| | |
|---|---|
| ***F24F 11/52*** | (2018.01) |
| ***F24F 11/58*** | (2018.01) |
| ***F24F 11/88*** | (2018.01) |
| *F24F 1/0007* | (2019.01) |

(56) References Cited

U.S. PATENT DOCUMENTS

| | | | | |
|---|---|---|---|---|
| 2017/0045251 | A1* | 2/2017 | Alsaleem | F24F 11/30 |
| 2018/0045424 | A1 | 2/2018 | Yajima et al. | |
| 2020/0088417 | A1* | 3/2020 | Ingram | F24F 13/32 |
| 2022/0003471 | A1* | 1/2022 | Welch | F25B 49/005 |
| 2022/0128277 | A1* | 4/2022 | Fukuyama | F24F 11/36 |
| 2022/0260293 | A1* | 8/2022 | Minami | F25B 13/00 |

FOREIGN PATENT DOCUMENTS

| | | | |
|---|---|---|---|
| JP | 2014-81160 | A | 5/2014 |
| JP | 2016-11767 | A | 1/2016 |
| JP | 2017-53571 | A | 3/2017 |
| JP | 6168113 | A | 7/2017 |
| JP | 2021-14961 | A | 2/2021 |
| WO | 2016/132906 | A1 | 8/2016 |

OTHER PUBLICATIONS

International Search Report of corresponding PCT Application No. PCT/JP2022/006937 dated Apr. 12, 2022.
European Search Report of corresponding EP Application No. 22 79 5248.8 dated Sep. 12, 2024.

* cited by examiner

INSTALLATION ASSISTANCE SYSTEM FOR AIR CONDITIONING DEVICE, INSTALLATION ASSISTANCE DEVICE, AND INSTALLATION ASSISTANCE METHOD

CROSS-REFERENCE TO RELATED APPLICATIONS

This is a continuation of International Application No. PCT/JP2022/006937 filed on Feb. 21, 2022, which claims priority to Japanese Patent Application No. 2021-076277, filed on Apr. 28, 2021. The entire disclosures of these applications are incorporated by reference herein.

BACKGROUND

Technical Field

The present disclosure relates to an installation assistance system, an installation assistance device, and an installation assistance method for an air conditioning device.

Background Art

If mildly-flammable refrigerant is used in an air conditioning device, it is mandatory to place a safety device based on the size of a room, the amount of refrigerant which may leak, etc. in order to avoid a risk upon leakage of such refrigerant. The safety device includes a detector (e.g., sensor) that detects the refrigerant leakage and a device such as a shut-off valve as measures against the refrigerant leakage.

Conventionally, the air conditioning device and the safety device interlock with each other to prevent the air conditioning device from operating in a dangerous state upon the refrigerant leakage. For example, in an air conditioning system of WO 2016/132906, if no signal from a ventilation device or a refrigerant leakage sensor is input to a control unit of an air conditioning device, operation of the air conditioning device is not started.

SUMMARY

A first aspect of the present disclosure is directed to an installation assistance system for an air conditioning device. The air conditioning device includes a first indoor unit and a second indoor unit interlocking with a safety device as a countermeasure against refrigerant leakage. The installation assistance system for the air conditioning device is configured to determine interlock release states of the first indoor unit and the second indoor unit based on information on the air conditioning device, and output a determination result. The information on the air conditioning device is information indicating whether or not the first indoor unit and the second indoor unit are short-circuited with the safety device through an interlock line.

DETAILED DESCRIPTION OF EMBODIMENT(S)

Embodiments

Figure 1:
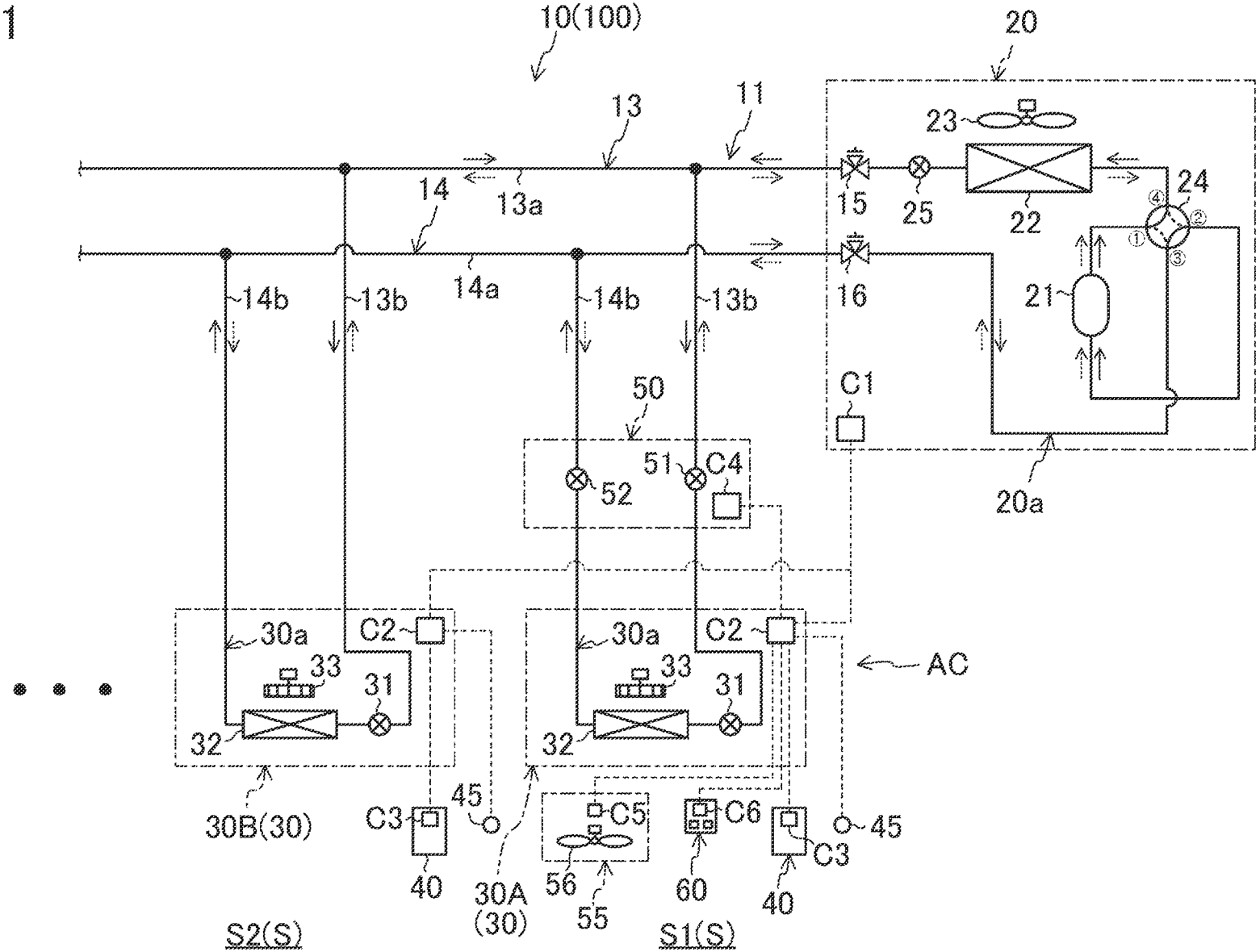
FIG. 1 is a piping system diagram illustrating, as an example, a configuration of an air conditioning system including an air conditioning device to which an installation assistance system of the present disclosure is applied.

Hereinafter, embodiments will be described with reference to the drawings. The embodiments below are merely exemplary ones in nature, and are not intended to limit the scope, application, or use of the invention. Since each of the drawings is intended to illustrate the present disclosure conceptually, dimensions, ratios, or numbers may be exaggerated or simplified as necessary for the sake of ease understanding.

Outline of Installation Assistance System An installation assistance system of the present disclosure is an installation assistance system for an air conditioning device (10) including a plurality of indoor units (30) interlocking with a safety device (45, 50, 55, 60) as countermeasures against refrigerant leakage. The installation assistance system determines an interlock release state of each indoor unit (30) based on information on the air conditioning device (10), and outputs a determination result. The plurality of indoor units (30) includes at least a first indoor unit (30A) and a second indoor unit (30B). The safety device (45, 50, 55, 60) is installed corresponding to an indoor space (S) requiring safety measures against the refrigerant leakage. The safety device (45, 50, 55, 60) includes a refrigerant sensor (45) that detects the refrigerant leakage and a device for taking measures against the refrigerant leakage based on a detection signal of the refrigerant sensor (45), specifically at least one of a shut-off device (50), a ventilation device (55), or an alarm device (60).

General Configuration of Air Conditioning System

Figure 2:
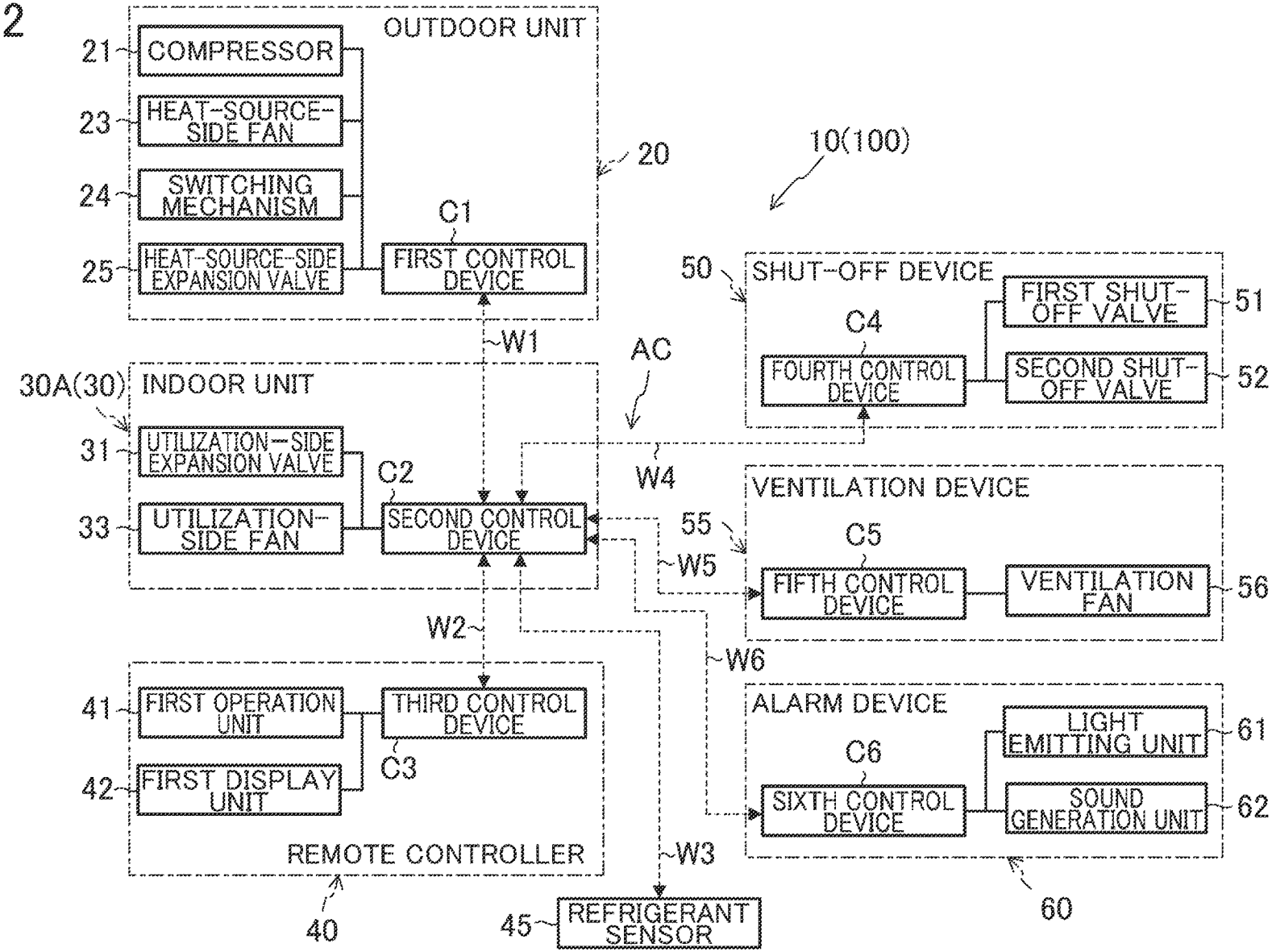
FIG. 2 is a block diagram illustrating a schematic configuration of the air conditioning system illustrated in FIG. 1.

An air conditioning system (100) including the air conditioning device (10) to which the installation assistance system of the present disclosure is applied will be described. As illustrated in FIGS. 1 and 2, the air conditioning system (100) includes the air conditioning device (10) and the safety device (45, 50, 55, 60).

The air conditioning device (10) adjusts the temperature of air in the indoor space (S) to be air-conditioned. The indoor space (S) of this example is an indoor space of a building or the like. The air conditioning device (10) performs cooling and heating of the indoor space (S). The air conditioning device (10) is a multi-type air conditioning device having a plurality of indoor units (30) as utilization-side units. The air conditioning device (10) has an outdoor unit (20) as a heat-source-side unit, the plurality of indoor units (30), connection pipes (13, 14), and an air conditioning control unit (AC). The plurality of indoor units (30) and the outdoor unit (20) are connected to each other through the connection pipes (13, 14). Such connection forms a refrigerant circuit (11) as a closed circuit. In this example, the plurality of indoor units (30) includes the first indoor unit (30A) arranged for a first indoor space (51) and the second indoor unit (30B) arranged for a second indoor space (S2).

The refrigerant circuit (11) includes a heat-source-side circuit (20*a*) provided in the outdoor unit (20) and utilization-side circuits (30*a*) each provided in the indoor units (30). The refrigerant circuit (11) is filled with mildly flammable refrigerant. The mildly flammable refrigerant in this example is R32 (difluoromethane). R32 has a relatively low global warming potential (GWP), but is mildly flammable. For this reason, if the refrigerant leaks into the indoor space (S) and a refrigerant concentration in the indoor space (S) becomes high, the refrigerant may be burned. The density of the refrigerant is greater than the density of air. For this reason, when the refrigerant leaks into the indoor space (S), the refrigerant stays in a lower portion in the indoor space (S).

The connection pipes (13, 14) include a first connection pipe (13) and a second connection pipe (14). The first connection pipe (13) is a liquid connection pipe. The first connection pipe (13) includes a first main pipe (13*a*) and a plurality of first branch pipes (13*b*) branched from the first main pipe (13*a*). One end of the first main pipe (13*a*) is connected to the heat-source-side circuit (20*a*) via a first shut-off valve (15) which is a liquid shut-off valve. One end of each of the plurality of first branch pipes (13*b*) is connected to the first main pipe (13*a*). The other end of each of the plurality of first branch pipes (13*b*) is connected to the corresponding utilization-side circuit (30*a*). The second connection pipe (14) is a gas connection pipe. The second connection pipe (14) includes a second main pipe (14*a*) and a plurality of second branch pipes (14*b*) branched from the second main pipe (14*a*). One end of the second main pipe (14*a*) is connected to the heat-source-side circuit (20*a*) via a second shut-off valve (16) which is a gas shut-off valve. One end of each of the plurality of second branch pipes (14*b*) is connected to the second main pipe (14*a*). The other end of each of the plurality of second branch pipes (14*b*) is connected to the corresponding utilization-side circuit (30*a*).

Configuration of Outdoor Unit

The outdoor unit (20) is a heat-source-side unit arranged outside. The outdoor unit (20) is arranged, for example, on the roof of a building or on the ground. The outdoor unit (20) has a compressor (21), a heat-source-side heat exchanger (22), and a heat-source-side fan (23). The outdoor unit (20) has a switching mechanism (24) that switches the flow path of refrigerant and a heat-source-side expansion valve (25). The outdoor unit (20) has a first control device (C1) included in the air conditioning control unit (AC).

The compressor (21) compresses sucked refrigerant. The compressor (21) discharges the compressed refrigerant. The compressor (21) is, for example, a rotary compressor of a scroll type, an oscillating piston type, a rolling piston type, or a screw type. The compressor (21) is configured to have a variable operation frequency (number of rotations) by an inverter device.

The heat-source-side heat exchanger (22) is an outdoor heat exchanger. The heat-source-side heat exchanger (22) is a fin-and-tube air heat exchanger. The heat-source-side heat exchanger (22) exchanges heat between refrigerant flowing therein and outdoor air.

The heat-source-side fan (23) is arranged outdoors in the vicinity of the heat-source-side heat exchanger (22). The heat-source-side fan (23) of this example is a propeller fan. The heat-source-side fan (23) delivers air passing through the heat-source-side heat exchanger (22).

The switching mechanism (24) changes the flow path of the refrigerant circuit (11) so as to switch between a first refrigeration cycle which is a cooling cycle and a second refrigeration cycle which is a heating cycle. The switching mechanism (24) is a four-way switching valve. The switching mechanism (24) has a first port, a second port, a third port, and a fourth port. The first port of the switching mechanism (24) is connected to the discharge portion of the compressor (21). The second port of the switching mechanism (24) is connected to the suction portion of the compressor (21). The third port of the switching mechanism (24) is connected to the second connection pipe (14) via the second shut-off valve (16). The fourth port of the switching mechanism (24) is connected to the gas end of the heat-source-side heat exchanger (22).

The switching mechanism (24) switches between a first state and a second state. The switching mechanism (24) in the first state (state indicated by solid lines in FIG. 1) causes the first port and the fourth port to communicate with each other, and causes the second port and the third port to communicate with each other. The switching mechanism (24) in the second state (state indicated by dashed lines in FIG. 1) causes the first port and the third port to communicate with each other, and causes the second port and the fourth port to communicate with each other.

The heat-source-side expansion valve (25) decompresses refrigerant. The heat-source-side expansion valve (25) is an outdoor expansion valve. The heat-source-side expansion valve (25) is arranged between the first shut-off valve (15) and the heat-source-side heat exchanger (22) in the heat-source-side circuit (20*a*). The heat-source-side expansion valve (25) is an electronic expansion valve whose opening degree is adjustable.

Configuration of Indoor Unit

The plurality of indoor units (30) of this example include the first indoor unit (30A) and the second indoor unit (30B). The number of indoor units (30) may be three or more. The configurations of the first indoor unit (30A) and the second indoor unit (30B) are basically the same as each other. Hereinafter, for the sake of convenience, each of the first indoor unit (30A) and the second indoor unit (30B) may be simply referred to as an indoor unit (30).

The indoor unit (30) is a utilization-side unit placed in a room of a building or the like. The term "room" as used herein includes a space behind a ceiling panel. The indoor unit (30) of this example is of a ceiling mounted type. The term "ceiling mounted type" as used herein includes a ceiling suspended type in which the indoor unit (30) is suspended and a ceiling embedded type in which the indoor unit (30) is arranged in an opening of a ceiling.

The indoor unit (30) has a utilization-side expansion valve (31), a utilization-side heat exchanger (32), and a utilization-side fan (33).

The utilization-side expansion valve (31) decompresses refrigerant. The utilization-side expansion valve (31) is an indoor expansion valve. The utilization-side expansion valve (31) is arranged in the liquid-side flow path of the utilization-side heat exchanger (32) in the utilization-side circuit (30*a*). The utilization-side expansion valve (31) is an electronic expansion valve whose opening degree is adjustable.

The utilization-side heat exchanger (32) is an indoor heat exchanger. The utilization-side heat exchanger (32) is a fin-and-tube air heat exchanger. The utilization-side heat exchanger (32) exchanges heat between refrigerant flowing therein and indoor air.

The utilization-side fan (33) is arranged in the vicinity of the utilization-side heat exchanger (32) in the room. The utilization-side fan (33) of this example is a centrifugal fan. The utilization-side fan (33) delivers air passing through the utilization-side heat exchanger (32).

The indoor unit (30) has a second control device (C2) included in the air conditioning control unit (AC). The second control device (C2) of each indoor unit (30) and the first control device (C1) of the outdoor unit (20) are connected to each other via a first communication line (W1). The first communication line (W1) is wired or wireless.

Remote Controller

The air conditioning device (10) includes a remote controller (40). One remote controller (40) of this example is provided for a corresponding one of the indoor units (30). The remote controller (40) is a device that operates the air conditioning device (10). As illustrated in FIG. 2, the remote controller (40) includes a first operation unit (41) and a first display unit (42) as functional units. In the present disclosure, the term "functional unit" includes a functional unit implemented only by hardware, a functional unit implemented only by software, and a functional unit implemented by cooperation of hardware and software.

The first operation unit (41) is a functional unit provided for a person to input various instructions to the air conditioning device (10). The first operation unit (41) includes a switch, a button, or a touch panel.

The first display unit (42) is a functional unit that displays the contents of the settings for the air conditioning device (10) and the state of the air conditioning device (10). The first display unit (42) includes a display.

The remote controller (40) has a third control device (C3) included in the air conditioning control unit (AC). The third control device (C3) and the second control device (C2) of the indoor unit (30) are connected to each other via a second communication line (W2). The second communication line (W2) is wired or wireless.

Safety Device

The air conditioning system (100) illustrated in FIG. 1 has the refrigerant sensor (45) as a detector serving as the safety device. In this embodiment, the refrigerant sensors (45) are provided for all the indoor spaces (S). The refrigerant sensor (45) is, for example, a semiconductor sensor. The refrigerant sensor (45) outputs a detection signal having a higher intensity (e.g., current value) as the concentration of the leaked refrigerant increases. The refrigerant sensor (45) is not limited to the semiconductor type, and may be of other types such as an infrared type. The refrigerant sensor (45) and the second control device (C2) of the first indoor unit (30A) are connected to each other via a third communication line (W3). The third communication line (W3) is wired or wireless. The detection signal output from the refrigerant sensor (45) is input to the second control device (C2) via the third communication line (W3).

The air conditioning system (100) has the shut-off device (50) as the safety device. The shut-off device (50) is provided corresponding to the indoor space (S) for which it has been determined that the safety device is necessary. In this example, the shut-off device (50) is provided for the first indoor space (51), i.e., the first indoor unit (30A). The shut-off device (50) has a first shut-off valve (51) and a second shut-off valve (52). The first shut-off valve (51) is a liquid-side shut-off valve. The first shut-off valve (51) of this example is provided in the first branch pipe (13*b*) connected to the first indoor unit (30A). The first shut-off valve (51) is an on-off valve such as an electromagnetic valve or an electric valve. The second shut-off valve (52) is a gas-side shut-off valve. The second shut-off valve (52) of this example is provided in the second branch pipe (14*b*) connected to the first indoor unit (30A). The second shut-off valve (52) is an on-off valve such as an electromagnetic valve or an electric valve. The shut-off device (50) has a fourth control device (C4). The fourth control device (C4) and the second control device (C2) of the first indoor unit (30A) are connected to each other via a fourth communication line (W4). The fourth communication line (W4) is wired or wireless.

The air conditioning system (100) has the ventilation device (55) as the safety device. The ventilation device (55) is provided corresponding to the indoor space (S) for which it has been determined that the safety device is necessary. In this example, the ventilation device (55) is provided corresponding to the first indoor space (S1), i.e., the first indoor unit (30A). The ventilation device (55) has a ventilation fan (56). The ventilation fan (56) discharges air in the indoor space (S) to the outside via an exhaust path (not shown). The ventilation device (55) has a fifth control device (C5). The fifth control device (C5) and the second control device (C2) of the first indoor unit (30A) are connected to each other via a fifth communication line (W5). The fifth communication line (W5) is wired or wireless.

In this embodiment, both the shut-off device (50) and the ventilation device (55) are provided in the indoor space (S) for which it has been determined that the safety device is necessary. Instead, only one of the shut-off device (50) or the ventilation device (55) may be provided.

The air conditioning system (100) has the alarm device (60) as the safety device. The alarm device (60) is provided corresponding to the indoor space (S) for which it has been determined that the safety device is necessary. In this example, the alarm device (60) is provided corresponding to the first indoor space (S1), i.e., the first indoor unit (30A). The alarm device (60) has a light emitting unit (61) and a sound generation unit (62). The light emitting unit (61) notifies a person of the refrigerant leakage by light. The light emitting unit (61) is, for example, an LED. The sound generation unit (62) notifies a person of the refrigerant leakage by sound. The sound generation unit (62) is, for example, a speaker. The alarm device (60) has a sixth control device (C6). The sixth control device (C6) and the second control device (C2) of the first indoor unit (30A) are connected to each other via a sixth communication line (W6). The sixth communication line (W6) is wired or wireless.

Air Conditioning Control Unit

The air conditioning control unit (AC) controls operation of the air conditioning device (10). The air conditioning control unit (AC) includes the first control device (C1), the second control device (C2), the third control device (C3), the first communication line (W1), the second communication line (W2), the third communication line (W3), the fourth communication line (W4), the fifth communication line (W5), and the sixth communication line (W6). The fourth control device (C4), the fifth control device (C5), and the sixth control device (C6) may also form part of the air conditioning control unit (AC). Each of the first control device (C1), the second control device (C2), the third control device (C3), the fourth control device (C4), the fifth control device (C5), and the sixth control device (C6) includes a micro control unit (MCU), an electric circuit, and an electronic circuit. The MCU includes a central processing unit (CPU), a memory, and a communications interface. The memory stores various programs to be executed by the CPU.

The first control device (C1) is an outdoor unit control unit. The first control device (C1) controls the compressor (21), the heat-source-side expansion valve (25), and the heat-source-side fan (23).

The second control device (C2) is an indoor unit control unit. The second control device (C2) controls the utilization-side expansion valve (31) and the utilization-side fan (33). The detection signal of the refrigerant sensor (45) is input to the second control device (C2). The second control device (C2) determines, based on the detection signal of the refrigerant sensor (45), whether or not a first condition indicating the refrigerant leakage is satisfied. When the first condition is satisfied, the second control device (C2) outputs a signal for operating the safety device (50, 55, 60).

The third control device (C3) outputs an instruction based on the input of the first operation unit (41) to the second control device (C2). The third control device (C3) causes the first display unit (42) to display predetermined information in response to the input of the first operation unit (41).

The fourth control device (C4) controls the open/close state of the first and second shut-off valves (51), (52). When the signal output from the second control device (C2) is input to the fourth control device (C4), the fourth control device (C4) closes the first and second shut-off valves (51), (52).

The fifth control device (C5) controls the ventilation fan (56). When the signal output from the second control device (C2) is input to the fifth control device (C5), the fifth control device (C5) operates the ventilation fan (56).

The sixth control device (C6) controls the light emitting unit (61) and the sound generation unit (62). When the signal output from the second control device (C2) is input to the sixth control device (C6), the sixth control device (C6) operates the light emitting unit (61) and the sound generation unit (62).

Centralized Monitoring Device

Figure 3:
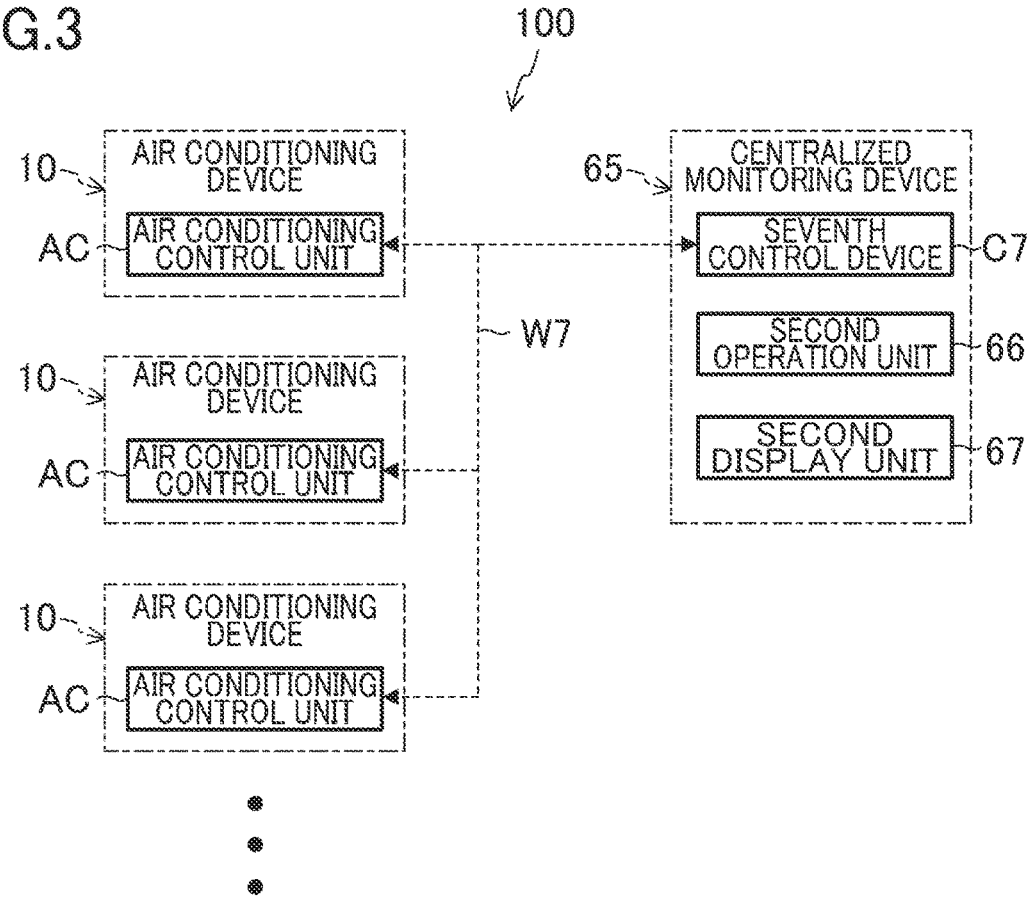
FIG. 3 is a block diagram illustrating a schematic configuration of an air conditioning system according to a variation.

The air conditioning device (10) is a single-system device having one refrigerant circuit (11). In a building or the like, an air conditioning system (1) including a plurality of systems of air conditioning devices (10) is built. In this case, as illustrated in FIG. 3, the air conditioning system (100) may have a plurality of air conditioning devices (10) and a centralized monitoring device (65). The centralized monitoring device (65) has a second operation unit (66) and a second display unit (67) as functional units. The second operation unit (66) is a functional unit provided for a person (e.g., manager) to input various instructions to each air conditioning device (10). The second operation unit (66) includes a switch, a button, or a touch panel. The second display unit (67) is a functional unit that displays the contents of the settings for each air conditioning device (10) and the state of each air conditioning device (10). The second display unit (67) includes a display. The centralized monitoring device (65) has a seventh control device (C7). The seventh control device (C7) and the air conditioning control unit (AC) of each air conditioning device (10) are connected to each other via a seventh communication line (W7). The seventh communication line (W7) is wired or wireless. The seventh control device (C7) includes an MCU, an electric circuit and an electronic circuit. The MCU includes a CPU, a memory, and a communication interface. The memory stores various programs to be executed by the CPU.

Operation of Air Conditioning Device

Operation of the air conditioning device (10) will be described with reference to FIG. 1. The air conditioning device (10) switchably performs the cooling operation and the heating operation. In FIG. 1, the flow of refrigerant in the cooling operation is indicated by solid arrows, and the flow of refrigerant in the heating operation is indicated by dashed arrows.

In the cooling operation, the first control device (C1) operates the compressor (21) and the heat-source-side fan (23), brings the switching mechanism (24) into the first state, and fully opens the heat-source-side expansion valve (25). The second control device (C2) operates the utilization-side fan (33), and adjusts the utilization-side expansion valve (31) to a predetermined opening degree. In the normal cooling operation, the first shut-off valve (51) and the second shut-off valve (52) are in the open state.

In the cooling operation, the refrigerant circuit (11) performs the first refrigeration cycle. In the first refrigeration cycle, the heat-source-side heat exchanger (22) functions as a radiator (precisely, a condenser), and the utilization-side heat exchanger (32) functions as an evaporator. Specifically, refrigerant compressed by the compressor (21) flows through the heat-source-side heat exchanger (22). In the heat-source-side heat exchanger (22), the refrigerant dissipates heat to the outdoor air to condense. The refrigerant condensed in the heat-source-side heat exchanger (22) flows through the first connection pipe (13), and is branched into each utilization-side circuit (30*a*). In each utilization-side circuit (30*a*), the refrigerant is decompressed by the utilization-side expansion valve (31), and then, flows through the utilization-side heat exchanger (32). In the utilization-side heat exchanger (32), the refrigerant absorbs heat from the indoor air to evaporate. The refrigerant evaporated in each utilization-side heat exchanger (32) join together in the second connection pipe (14), and then, is sucked into the compressor (21).

In the heating operation, the first control device (C1) operates the compressor (21) and the heat-source-side fan (23), brings the switching mechanism (24) into the second state, and adjusts the heat-source-side expansion valve (25) to a predetermined opening degree. The second control device (C2) operates the utilization-side fan (33), and adjusts the utilization-side expansion valve (31) to a predetermined opening degree. In the normal heating operation, the first shut-off valve (51) and the second shut-off valve (52) are in the open state.

In the heating operation, the refrigerant circuit (11) performs the second refrigeration cycle. In the second refrigeration cycle, the utilization-side heat exchanger (32) functions as a radiator (precisely, a condenser), and the heat-source-side heat exchanger (22) functions as an evaporator. Specifically, refrigerant compressed by the compressor (21) flows through the second connection pipe (14), and is branched into each utilization-side circuit (30*a*). In each utilization-side circuit (30*a*), the refrigerant flows through the utilization-side heat exchanger (32). In the utilization-side heat exchanger (32), the refrigerant dissipates heat to the indoor air to condense. The refrigerant condensed in each utilization-side heat exchanger (32) is decompressed by a corresponding one of the utilization-side expansion valves (31), and then, join together in the first connection pipe (13). The refrigerant in the first connection pipe (13) is decompressed by the heat-source-side expansion valve (25), and then, flows through the heat-source-side heat exchanger (22). In the heat-source-side heat exchanger (22), the refrigerant absorbs heat from the outdoor air to evaporate. The refrigerant evaporated in the heat-source-side heat exchanger (22) is sucked into the compressor (21).

Operation upon Refrigerant Leakage

Figure 4:
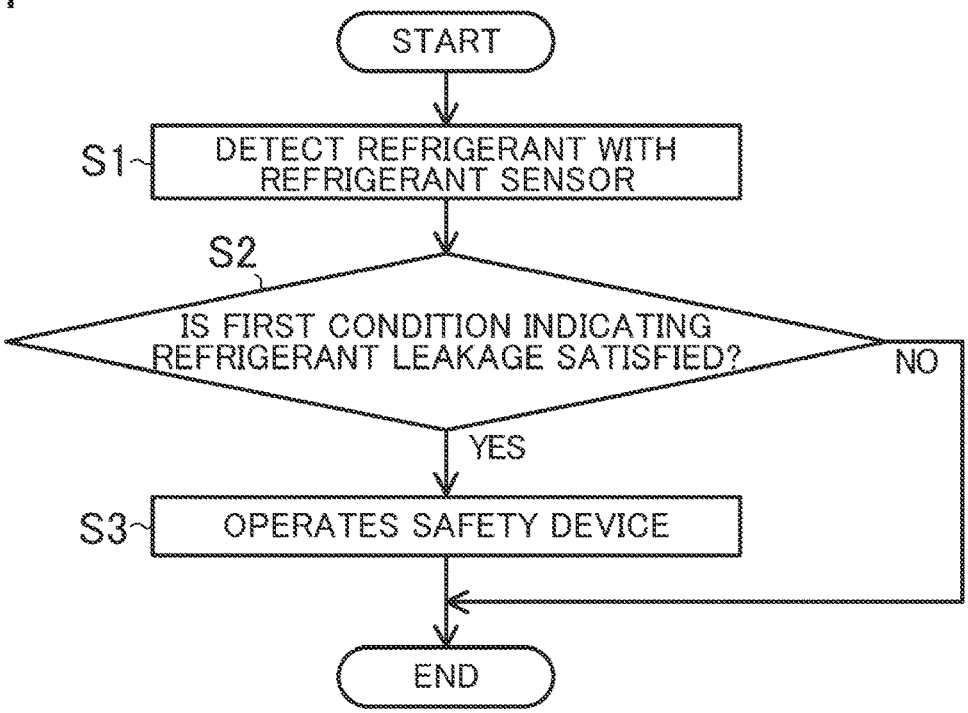
FIG. 4 is a flowchart illustrating operation of a safety device of the air conditioning system illustrated in FIG. 1.

Operation of the air conditioning system (100) upon the refrigerant leakage will be described with reference to FIG. 4. When refrigerant leaks from the first indoor unit (30A), the leaked refrigerant flows into the first indoor space (51). Specifically, since the density of refrigerant is greater than the density of air, the refrigerant flows downward in the first indoor space (51). As a result, the concentration of the refrigerant in the first indoor space (51) gradually increases.

In Step S1, the refrigerant sensor (45) detects the refrigerant leakage. A detection value of the refrigerant sensor (45) is input to the second control device (C2) of the first indoor unit (30A) via the third communication line (W3).

In Step S2, the second control device (C2) determines, based on the detection signal of the refrigerant sensor (45), whether or not the first condition indicating the refrigerant leakage is satisfied. The first condition is whether or not the detection value (e.g., current value) of the refrigerant sensor (45) is a predetermined value or more. When the first condition is satisfied, the second control device (C2) outputs the signal for operating the safety device (50, 55, 60).

When the signal output from the second control device (C2) is input to the safety device (50, 55, 60), the safety device (50, 55, 60) is operated in Step S3. Specifically, in Step S3, when the signal output from the second control device (C2) is input to the fourth control device (C4), the fourth control device (C4) closes the first and second shut-off valves (51), (52) of the shut-off device (50). In Step S3, when the signal output from the second control device (C2) is input to the fifth control device (C5), the fifth control device (C5) operates the ventilation fan (56). In Step S3, when the signal output from the second control device (C2) is input to the sixth control device (C6), the sixth control device (C6) operates the light emitting unit (61) and the sound generation unit (62). More specifically, the sixth control device (C6) causes the light emitting unit (61) to emit light. In addition, the sixth control device (C6) causes the sound generation unit (62) to generate sound such as warning sound.

Through the above-described operation, the refrigerant in the refrigerant circuit (11) of the air conditioning device (10) of one system can be prevented from leaking into the first indoor space (51).

Configuration of Installation Assistance System

The installation assistance system of the present disclosure is used by a user such as a constructor upon installation of the air conditioning device (10) including the plurality of indoor units (30) interlocking with the safety device (45, 50, 55, 60). The user can quickly and properly perform a work necessary for releasing the interlock by using the installation assistance system of the present disclosure.

Figure 5:
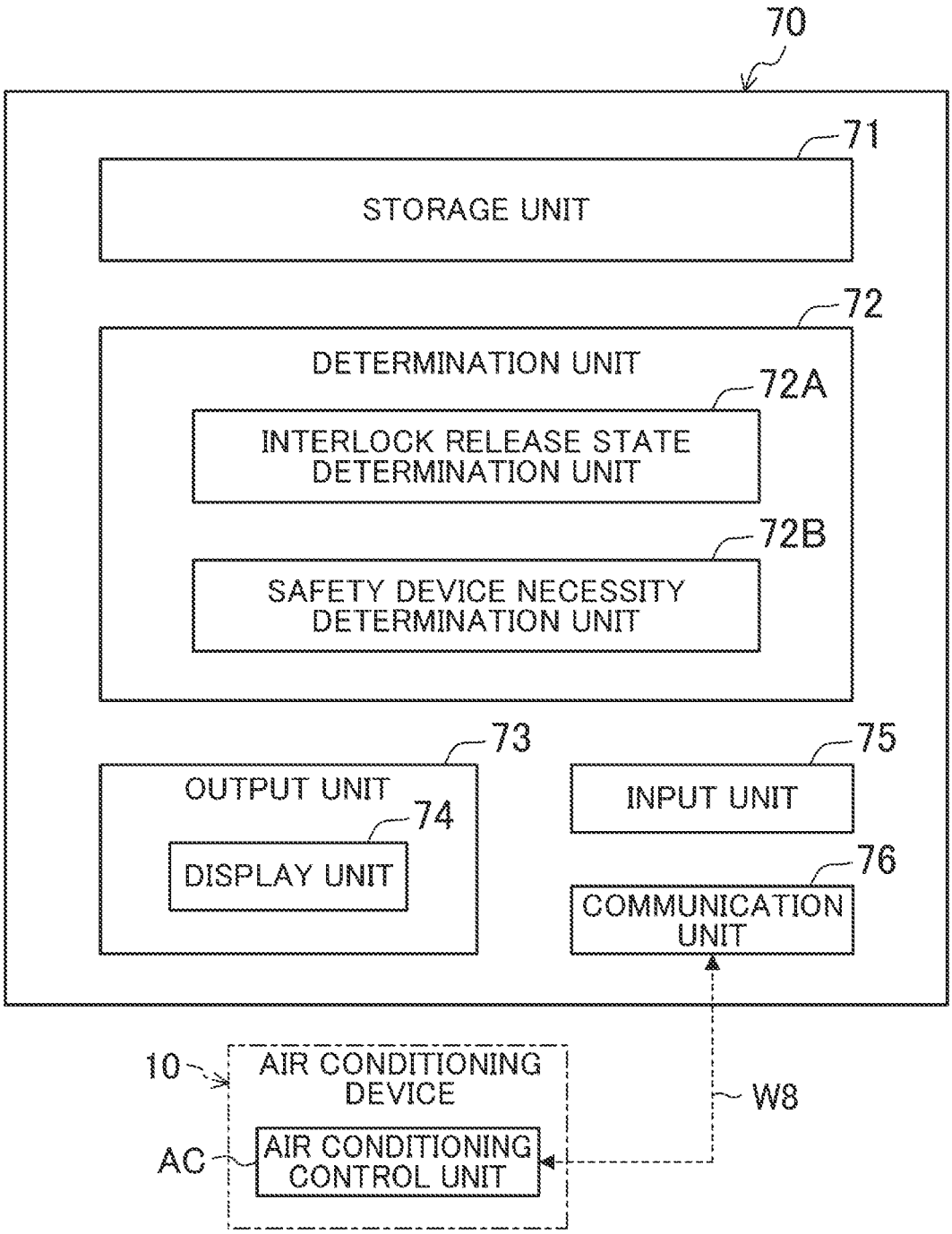
FIG. 5 is a block diagram illustrating a schematic configuration of an installation assistance device which is one example of the installation assistance system of the present disclosure.

FIG. 5 is a block diagram illustrating a schematic configuration of an installation assistance device (70) which is one example of the installation assistance system of the present disclosure. The installation assistance device (70) may include, for example, a dedicated mobile terminal such as a laptop computer or a tablet.

As illustrated in FIG. 5, the installation assistance device (70) mainly includes a storage unit (71), a determination unit (72), and an output unit (73). The installation assistance device (70) may further include an input unit (75) and a communication unit (76).

The storage unit (71) mainly includes a storage device such as a RAM, an HDD, or an SSD. The storage unit (71) stores a program to be executed by the determination unit (72), data used by such a program, etc. Specifically, the storage unit (71) stores, as information on the air conditioning device (10), information on whether or not the interlock between the plurality of indoor units (30) and the safety device (45, 50, 55, 60) is released, for example. In addition, the storage unit (71) may store, as the information on the air conditioning device (10), information including, for example, the floor area of the indoor space (S) in which each indoor unit (30) is installed, the amount of refrigerant used in the air conditioning device (10), and the length of a pipe connected to each indoor unit (30).

The determination unit (72) mainly includes a CPU. The determination unit (72) has an interlock release state determination unit (72A) and a safety device necessity determination unit (72B). The interlock release state determination unit (72A) determines, based on the information on the air conditioning device (10) in the storage unit (71), the interlock release states of the plurality of indoor units (30). The safety device necessity determination unit (72B) determines, based on the information on the air conditioning device (10) in the storage unit (71), the necessity of providing the safety device (45, 50, 55, 60) for each indoor unit (30). The interlock release state determination unit (72A) and the safety device necessity determination unit (72B) may be programs to be executed by the CPU. Details of the interlock release state determination unit (72A) and the safety device necessity determination unit (72B) will be described later.

The output unit (73) outputs a determination result of the determination unit (72). In order to display the determination result to the user, the output unit (73) may have a display unit (74) such as a display or a printer. Alternatively, the output unit (73) may have only a function of outputting the determination result of the determination unit (72) to a display device outside the installation assistance device (70). If the output unit (73) has the display unit (74), an interface or the like for starting the processing of the program executed by the determination unit (72) may be displayed on the display unit (74).

The input unit (75) may be an input device such as a keyboard or a mouse. The user, e.g., an installation worker, of the installation assistance device (70) may operate the installation assistance device (70) by operating the input unit (75). The input unit (75) may be integrated as a touch panel function-equipped display with the output unit (73).

The communication unit (76) is an interface for a communication network and an external device. The communication unit (76) may be, for example, a network interface for connecting the installation assistance device (70) to a communication network such as the Internet or a general-purpose interface for connecting the installation assistance device (70) to an external device such as a display.

In this embodiment, as illustrated in FIG. 5, the communication unit (76) and the air conditioning control unit (AC) of the air conditioning device (10) are connected to each other via an eighth communication line (W8). The eighth communication line (W8) is wired or wireless.

By connecting the installation assistance device (70) to the air conditioning device (10) (e.g., air conditioning control unit (AC)) via the communication unit (76) and the eighth communication line (W8), the installation assistance device (70) can acquire various types of information on the air conditioning device (10) and store the information in the storage unit (71). If the output unit (73) does not include the display unit (74), the output unit (73) can transmit the determination result of the determination unit (72) to an external display or the like via the communication unit (76).

Operation for Determining Interlock Release State

Figure 6:
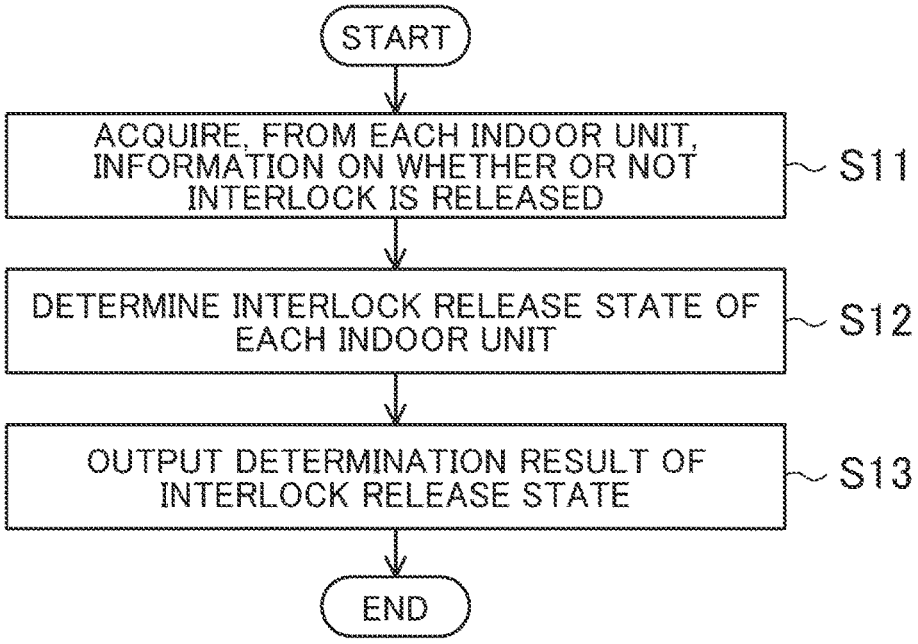
FIG. 6 is a flowchart illustrating interlock release state determination operation in operation (installation assistance method) of the installation assistance device illustrated in FIG. 5.

FIG. 6 is a flowchart illustrating one example of interlock release state determination operation in operation (installation assistance method) of the installation assistance device (70) illustrated in FIG. 5. In the following description, it is assumed that the installation assistance device (70) is connected to the air conditioning device (10), specifically the air conditioning control unit (AC), via the communication unit (76) and the eighth communication line (W8).

First, in Step S11, the installation assistance device (70) acquires, as the information on the air conditioning device (10), the information on whether or not the interlock is released from the plurality of indoor units (30) via the communication unit (76) and the eighth communication line (W8), and stores the information in the storage unit (71). Specifically, the installation assistance device (70) recognizes the connected indoor unit (30) via the communication unit (76) and the eighth communication line (W8), and requests the recognized indoor unit (30) to provide information on whether or not an interlock line is short-circuited. Thereafter, the installation assistance device (70) causes the storage unit (71) store the information, which is acquired from the indoor unit (30), on whether or not the interlock line is short-circuited.

If plural types of safety devices (45, 50, 55, 60) are provided for each indoor unit (30), the installation assistance device (70) may acquire, from each indoor unit (30), information indicating with which one or more of the plural types of safety devices (45, 50, 55, 60) the interlocks are released.

In addition, the air conditioning device (10) is initially shipped in a state in which the interlock with each safety device (45, 50, 55, 60) is necessary for the air conditioning device (10). Thereafter, upon installation of the air conditioning device (10), each indoor unit (30) and each safety device (45, 50, 55, 60) are short-circuited using the interlock line, and consequently the interlock is released. Thus, each indoor unit (30) (specifically, second control device (C2)) can grasp whether or not such an indoor unit (30) is connected to each safety device (45, 50, 55, 60) via the interlock line.

In addition, in this embodiment, the information on whether or not the interlock line is short-circuited is transmitted from the indoor unit (30) to the installation assistance device (70), and based on such information, the installation assistance device (70) determines, in later-described Step S12, whether or not the interlock of the indoor unit (30) is released. Instead, the indoor unit (30) (second control device (C2)) itself may determine, based on the information on whether or not the interlock line is short-circuited, whether or not the interlock is released.

Next, in Step S12, the interlock release state determination unit (72A) of the installation assistance device (70) determines, based on the information on the air conditioning device (10) stored in the storage unit (71) in Step S11, whether or not the interlock of each indoor unit (30) is released. If the plural types of safety devices (45, 50, 55, 60) are provided for each indoor unit (30), the interlock release state determination unit (72A) may determine whether or not the interlock between each indoor unit (30) and each safety device (45, 50, 55, 60) is released.

In this embodiment, if it is determined in Step S12 that the interlocks of all the indoor units (30) are released, operation of the air conditioning device (10) is permitted.

On the other hand, if it is determined in Step S12 that the interlock of any of the indoor units (30) is not released, the output unit (73) of the installation assistance device (70) outputs, in Step S13, the result of the determination made by the interlock release state determination unit (72A) in Step S12 as to whether or not the interlock of each indoor unit (30) is released. If the plural types of safety devices (45, 50, 55, 60) are provided for each indoor unit (30), the output unit (73) may output, for the indoor unit (30) whose interlock is not released among the plurality of indoor units (30), information indicating with which one or more of the plural types of safety devices (45, 50, 55, 60) the interlocks are not released. If the output unit (73) has the display unit (74), the display unit (74) may display the determination result of the interlock release state of each indoor unit (30) to the user such as the installation worker.

If the information on the indoor unit (30) whose interlock is not released is output, it is determined whether or not the indoor unit (30) requires the interlock, for example, by making later-described safety device necessity determination illustrated in FIG. 7, and if necessary, interlock releasing operation is performed on such an indoor unit (30). After necessary measures have been taken for all the indoor units (30) for which it is determined in Step S12 that the interlock is not released, the processing of Step S11 and the subsequent steps is performed again, and if it is determined in Step S12 that the interlocks of all the indoor units (30) are released, operation of the air conditioning device (10) is permitted.

Operation for Determining Necessity of Safety Device

Figure 7:
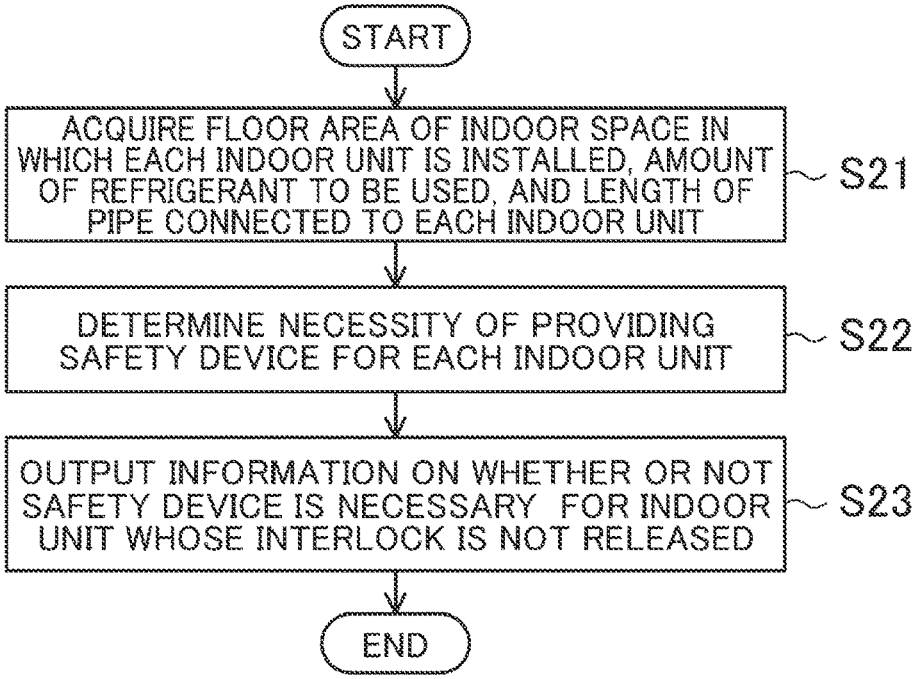
FIG. 7 is a flowchart illustrating safety device necessity determination operation in operation (installation assistance method) of the installation assistance device illustrated in FIG. 5.

FIG. 7 is a flowchart illustrating one example of safety device necessity determination operation in operation (installation assistance method) of the installation assistance device (70) illustrated in FIG. 5. Some of the indoor units (30) whose interlocks with the safety device (45, 50, 55, 60) are not released need to be provided with the safety device (45, 50, 55, 60), and the other indoor units (30) whose interlocks with the safety device (45, 50, 55, 60) do not need to be provided with the safety device (45, 50, 55, 60). For the indoor units (30) which do not need to be provided with the safety device (45, 50, 55, 60), the installation worker needs to release the interlock by, for example, short-circuiting a dedicated interlock line.

First, in Step S21, the installation assistance device (70) acquires, as the information on the air conditioning device (10), the information including the floor area of the indoor space (S) in which each indoor unit (30) is installed, the amount of refrigerant used in the air conditioning device (10), and the length of the pipe connected to each indoor unit (30), and stores the information in the storage unit (71).

The floor area of the indoor space (S) means the area of the bottom surface of a columnar body such as a quadrangular prism or a circular cylinder if the shape of the indoor space (S) is considered as the columnar body. For example, the installation assistance device (70) may incorporate space information, which is drawing data (e.g., CAD file or PDF file) on the indoor space (S), from the outside via the communication unit (76), and then acquire the floor area of the indoor space (S) based on the space information. The installation assistance device (70) may incorporate space information stored in an external storage device such as a USB memory via the communication unit (76) which is a general-purpose interface. Alternatively, the installation assistance device (70) may incorporate space information stored in, e.g., a server on a network via the communication unit (76) which is a network interface. Alternatively, the installation assistance device (70) may incorporate image data, which is obtained by scanning a printed drawing of the indoor space (S) using an external input device such as an image scanner, as space information via the communication unit (76) which is a general-purpose interface.

The amount of refrigerant used in the air conditioning device (10) and the length of the pipe connected to each indoor unit (30) are determined based on the specifications of the outdoor unit (20) and the indoor unit (30) (e.g., the capacity of the compressor and the capacity of the refrigerant flow path of the heat exchanger), the number of indoor units (30), and the like. These pieces of information may be incorporated from an external storage device such as a USB memory via the communication unit (76) which is a general-purpose interface, or may be incorporated from a server or the like on a network via the communication unit (76) which is a network interface. The number of indoor units (30) and the length of the pipe connected to each indoor unit (30) may be input by the user of the installation assistance device (70) via the input unit (75), or may be automatically set by the installation assistance device (70) based on, e.g., a drawing of a property in which the air conditioning device (10) is placed.

Next, in Step S22, the safety device necessity determination unit (72B) of the installation assistance device (70) determines, based on the information on the air conditioning device (10) stored in the storage unit (71) in Step S21, the necessity of providing the safety device (45, 50, 55, 60) for each indoor unit (30).

The safety device necessity determination unit (72B) calculates the acceptable refrigerant amount of the indoor space (S) based on at least the floor area of the indoor space (S) in order to determine the necessity of providing the safety device (45, 50, 55, 60). The acceptable refrigerant amount is the amount of refrigerant allowed to stay in the indoor space (S) in which the indoor unit (30) is placed if refrigerant leaks from the air conditioning device (10) including the indoor unit (30). That is, it is necessary to provide the safety device (45, 50, 55, 60) for the indoor unit (30) in which refrigerant exceeding the acceptable refrigerant amount may stay in the indoor space (S) at the time of the refrigerant leakage.

In this embodiment, the safety device necessity determination unit (72B) may calculate the acceptable refrigerant amount of the indoor space (S) based on, for example, the floor area of the indoor space (S), the leakage height of the indoor space (S), and a refrigerant parameter, which are stored in the storage unit (71).

The leakage height of the indoor space (S) is the height position of a location where refrigerant leaks if the refrigerant leaks from, e.g., the indoor unit (30) into the indoor space (S). The leakage height of the indoor space (S) is a position based on the height position of the floor of the indoor space (S). The leakage height of the indoor space (S) varies depending on the type of indoor unit (30) placed in the indoor space (S). For example, for the indoor unit (30) embedded in the ceiling of the indoor space (S), the leakage height of the indoor space (S) is the height position of the ceiling of the indoor space (S). For the indoor unit (30) attached to a wall of the indoor space (S), the leakage height of the indoor space (S) is the height position of the outlet of the indoor unit (30). The leakage height of the indoor space (S) may be set to a predetermined value in advance according to the dimensions of the indoor space (S) and the type of indoor unit (30) placed in the indoor space (S). Alternatively, the safety device necessity determination unit (72B) may set the leakage height of the indoor space (S) based on the space information on the indoor space (S) and the type of indoor unit (30).

The refrigerant parameter is set according to the properties of refrigerant used in the air conditioning device (10). The refrigerant parameter is calculated based on, for example, the density of refrigerant, the combustibility of refrigerant, and the lower limit of combustion (LFL) of refrigerant.

In this embodiment, the safety device necessity determination unit (72B) may calculate an acceptable refrigerant amount V based on, for example, Equation (1) below.

$$V=k\times L\times h\times S \tag{1}$$

In Equation (1), the variable k is a dimensionless value based on the combustibility of refrigerant used by the air conditioning device (10). For example, if the refrigerant is flammable, k may be set to 0.25, and if the refrigerant is non-flammable, k may be set to 0.50. The flammable refrigerant is, for example, R32. The non-flammable refrigerant is, for example, carbon dioxide.

In Equation (1), the variable L is the lower limit of combustion of refrigerant used by the air conditioning device (10). The lower limit of combustion of the refrigerant is the lower limit of the concentration of the refrigerant in a combustion range. In the combustion range, the mixture of refrigerant and air is combustible or ignitable. The variable L is a dimensionless value. The refrigerant parameter corresponds to the product of the variable k and the variable L.

In Equation (1), the variable h is the leakage height (unit: m) of the indoor space (S), and the variable S is the floor area (unit: $m^2$) of the indoor space (S). The acceptable refrigerant amount V (unit: $m^3$) is calculated by multiplying all the four variables k, L, h, S. The acceptable refrigerant amount V of the indoor space (S) calculated by the safety device necessity determination unit (72B) may be stored in the storage unit (71).

In Step S22, the safety device necessity determination unit (72B) compares the acceptable refrigerant amount V of the indoor space (S) calculated as described above with the amount of refrigerant stored in the storage unit (71) in Step 21 and used in the air conditioning device (10) (hereinafter referred to as "refrigerant usage"). If the refrigerant usage is greater than the acceptable refrigerant amount V, the safety device necessity determination unit (72B) determines that the indoor unit (30) placed in the indoor space (S) needs to be provided with the safety device (45, 50, 55, 60). The safety device necessity determination unit (72B) may determine the necessity of providing the safety device (45, 50, 55, 60) for all the indoor spaces (S), i.e., all the indoor units (30), or may determine the necessity of providing the safety device (45, 50, 55, 60) for the indoor unit (30) whose interlock is considered not released by the interlock release state determination unit (72A).

Next, in Step S23, the output unit (73) of the installation assistance device (70) outputs the result of the determination made by the safety device necessity determination unit (72B) in Step S22 as to the necessity of providing the safety device (45, 50, 55, 60) for each indoor unit (30). Here, the output unit (73) may output information on whether or not the safety device (45, 50, 55, 60) is required for the indoor unit (30) whose interlock is not released among the plurality of indoor units (30). If the output unit (73) has the display unit (74), the display unit (74) may display the determination result of the necessity of the safety device (45, 50, 55, 60) for each indoor unit (30) to the user such as the installation worker.

Implementation of Installation Assistance System

The installation assistance device (70) illustrated in FIG. 5 has been described as one implementation example of the installation assistance system of the present disclosure. In the installation assistance device (70), the program stored in the storage unit (71) is executed by the computer to perform the installation assistance method (processing of Steps S11 to S13 and S21 to S23) illustrated in FIGS. 6 and 7.

However, implementation of the installation assistance system of the present disclosure is not limited to the installation assistance device (70). For example, the installation assistance system of the present disclosure may be implemented by providing functions equivalent to those of the installation assistance device (70) in the air conditioning control unit (AC) (specifically, the first control device (C1) of the outdoor unit (20) or the second control device (C2) of each indoor unit (30)), the seventh control device (C7) of the centralized monitoring device (65), or the like. In this case, the functions of the installation assistance device (70) may be distributed to a plurality of control devices.

The installation assistance device (70) is configured using the dedicated mobile terminal such as the laptop computer or the tablet, but instead, a functional unit of the installation assistance device (70) mainly equivalent to the output unit (73) (including the display unit (74)) and the input unit (75) may be provided in a terminal device (e.g., a smartphone), and a functional unit mainly equivalent to the storage unit (71) and the determination unit (72) may be provided in a server device. The terminal device and the server device are connected to each other via a communication line such as the Internet, whereby the installation assistance system of the present disclosure is implemented.

Features of Embodiment

The installation assistance system of this embodiment is the installation assistance system for the air conditioning device (10) including the plurality of indoor units (30) interlocking with the safety device (45, 50, 55, 60) as the countermeasures against the refrigerant leakage. The installation assistance system of this embodiment determines the interlock release states of the plurality of indoor units (30) based on the information on the air conditioning device (10), and outputs the determination result. Thus, even if operation of the air conditioning device (10) cannot be started because the interlock is not released, the installation worker can easily grasp the interlock release state of each indoor unit (30) by using the output result of the installation assistance system. Specifically, since it is possible to determine the indoor unit (30) whose interlock is not released or the indoor unit (30) whose interlock is released, it is possible to grasp the indoor unit (30) which requires an additional work. Thus, the work necessary for releasing the interlock can be performed quickly and properly, so that the installation work of the air conditioning device (10) can be performed quickly.

In the installation assistance system of this embodiment, when the determination result is displayed to the user, the determination result of the interlock release state of each indoor unit (30) is displayed. Thus, the installation worker can more easily grasp the interlock release state of each indoor unit (30).

In the installation assistance system of this embodiment, when the information on whether or not the interlock is released is acquired from the plurality of indoor units (30), the interlock release state of each indoor unit (30) can be determined based on such information, and the determination result can be output.

In the installation assistance system of this embodiment, the plurality of indoor units (30) interlock with the plural types of safety devices (45, 50, 55, 60), and the information indicating with which one or more of the plural types of safety devices (45, 50, 55, 60) the interlocks are released may be acquired from the plurality of indoor units (30). With this configuration, it is possible to output, based on the acquired information, the information on the indoor unit (30) whose interlock is not released, where the information further indicates with which one or more of the safety devices (45, 50, 55, 60) the interlocks are not released. As a result, the installation worker can more quickly and properly perform the work necessary for releasing the interlock. In the installation assistance system of this embodiment, the information on the indoor unit (30) whose interlock is not released among the plurality of indoor units (30), where the information further indicates with which one or more of the plural types of safety devices (45, 50, 55, 60) the interlocks are not released, may be output. With this configuration, the installation worker can more easily grasp the work necessary for releasing the interlock by using the output information.

In the installation assistance system of this embodiment, the necessity of providing the safety device (45, 50, 55, 60) may be determined for each of the plurality of indoor units (30), and then the information on the indoor unit (30) whose interlock is not released among the plurality of indoor units (30), where the information further indicates whether or not the safety device (45, 50, 55, 60) is necessary, may be output. With this configuration, the necessity of the safety device (45, 50, 55, 60) for the indoor unit (30) whose interlock needs to be released is output. Thus, the installation worker can more accurately grasp the work necessary for releasing the interlock by using the output information.

In the installation assistance system of this embodiment, the information including the floor area of each of the indoor spaces (S) in which the plurality of indoor units (30) are installed, the amount of refrigerant used in the air conditioning device (10), and the lengths of the pipes connected to the plurality of indoor units (30) may be acquired, and based on the acquired information, the necessity of providing the safety device (45, 50, 55, 60) for the plurality of indoor units (30) may be determined. With this configuration, the necessity of the safety device (45, 50, 55, 60) for each indoor unit (30) can be accurately determined.

The installation assistance device (70) of this embodiment is one implementation example of the installation assistance system described above, and is the installation assistance device (70) for the air conditioning device (10) including the plurality of indoor units (30) interlocking with the safety device (45, 50, 55, 60) as the countermeasures against the refrigerant leakage. The installation assistance device (70) includes the storage unit (71) that stores the information on the air conditioning device (10), the determination unit (72) that determines the interlock release states of the plurality of indoor units (30) based on the information on the air conditioning device (10) in the storage unit (71), and the output unit (73) that outputs the determination result of the determination unit (72). Thus, even if operation of the air conditioning device (10) cannot be started because the interlock is not released, the installation worker can easily grasp the interlock release state of each indoor unit (30) by using the output result of the installation assistance device (70). Thus, the work necessary for releasing the interlock can be performed quickly and properly, so that the installation work of the air conditioning device (10) can be performed quickly.

In the installation assistance device (70) of this embodiment, if the output unit (73) has the display unit (74), the determination result of the interlock release state of each indoor unit (30) is displayed. Thus, the installation worker can more easily grasp the interlock release state of each indoor unit (30).

The installation assistance method of this embodiment is the installation assistance method for the air conditioning device (10) including the plurality of indoor units (30) interlocking with the safety device (45, 50, 55, 60) as the countermeasures against the refrigerant leakage. The installation assistance method of this embodiment determines the interlock release states of the plurality of indoor units (30) based on the information on the air conditioning device (10), and outputs the determination result. Thus, even if operation of the air conditioning device (10) cannot be started because the interlock is not released, the installation work of the air conditioning device (10) can be quickly performed.

Other Embodiments

The above-described embodiment (including variations: the same also applies hereinafter) may include the following configurations.

1) The air conditioning device (10) is not necessarily of the multi-type, but may be of a pair-type including one indoor unit (30) and one outdoor unit (20). The air conditioning device (10) may have a plurality of outdoor units (20).
2) The refrigerant circuit (11) may be filled with refrigerant other than R32. The refrigerant includes refrigerants equivalent to Class 3 (strongly flammable), Class 2 (weakly flammable), and Subclass 2L (mildly flammable) in the US standards of ASHRAE 34 Designation and Safety Classification of Refrigerant or the standards of ISO 817 Refrigerants-Designation and Safety Classification.

For example, the refrigerant is a single component refrigerant such as R1234yf, R1234ze(E), R516A, R445A, R444A, R454C, R444B, R454A, R455A, R457A, R459B, R452B, R454B, R447B, R32, R447A, R446A, or R459.

Alternatively, the refrigerant is a refrigerant mixture of two or more refrigerants selected from a group consisting of R1234yf, R1234ze(E), R516A, R445A, R444A, R454C, R444B, R454A, R455A, R457A, R459B, R452B, R454B, R447B, R32, R447A, R446A, and R459.

3) The switching mechanism (24) is not necessarily the four-way switching valve. The switching mechanism (24) may be a combination of four flow paths and on-off valves that open and close these four flow paths, or may be a combination of two three-way valves.
4) The heat-source-side expansion valve (25) and the utilization-side expansion valve (31) are not necessarily the electronic expansion valves, and may be temperature-sensitive expansion valves or
5) The indoor unit (30) is not necessarily of the ceiling mounted type, but may be of a wall mounted type or a floor mounted type.

While the embodiments have been described above, it will be understood that various changes in form and details can be made without departing from the spirit and scope of the claims. The embodiments described above may be appropriately combined or modified by replacing the elements thereof, as long as the functions of the subject matters of the present disclosure are not impaired. The expressions of "first," "second," . . . described above are used to distinguish the terms to which these expressions are given, and do not limit the number and order of the terms.

As described above, the present disclosure is useful for the installation assistance system, the installation assistance device, and the installation assistance method for the air conditioning device.

The invention claimed is:

1. An installation assistance system for an air conditioning device including a first indoor unit and a second indoor unit interlocking with a safety device as a countermeasure against refrigerant leakage, the safety device including at least one of a refrigerant sensor, a shut-off device, a ventilation device and an alarm device, the installation assistance system being configured to determine interlock release states of the first indoor unit and the second indoor unit based on information on the air conditioning device, and output a determination result, the information on the air conditioning device being information indicating whether or not the first indoor unit and the second indoor unit are short-circuited with the safety device through an interlock line.

2. The installation assistance system for the air conditioning device of claim 1, wherein the determination result is displayed to a user.

3. The installation assistance system for the air conditioning device according to claim 1, wherein information on whether or not the interlock is released is acquired from the first indoor unit and the second indoor unit.

4. The installation assistance system for the air conditioning device according to claim 2, wherein information on whether or not the interlock is released is acquired from the first indoor unit and the second indoor unit.

5. The installation assistance system for the air conditioning device according to claim 3, wherein the first indoor unit and the second indoor unit interlock with plural types of safety devices, and information indicating with which one or more of the plural types of safety devices the interlocks are released is acquired from the first indoor unit and the second indoor unit.

6. The installation assistance system for the air conditioning device according to claim 5, wherein information on an indoor unit whose interlock is not released of the first indoor unit and the second indoor unit, where the information further indicates with which one or more of the plural types of safety devices the interlocks are not released, is output.

7. The installation assistance system for the air conditioning device according to claim 1, wherein a necessity of providing the safety device is determined for each of the first indoor unit and the second indoor unit, and information on an indoor unit whose interlock is not released of the first indoor unit and the second indoor unit, where the information further indicates whether or not the safety device is necessary, is output.

8. The installation assistance system for the air conditioning device according to claim 2, wherein a necessity of providing the safety device is determined for each of the first indoor unit and the second indoor unit, and information on an indoor unit whose interlock is not released of the first indoor unit and the second indoor unit, where the information further indicates whether or not the safety device is necessary, is output.

9. The installation assistance system for the air conditioning device according to claim 3, wherein a necessity of providing the safety device is determined for each of the first indoor unit and the second indoor unit, and information on an indoor unit whose interlock is not released of the first indoor unit and the second indoor unit, where the information further indicates whether or not the safety device is necessary, is output.

10. The installation assistance system for the air conditioning device according to claim 5, wherein a necessity of providing the safety device is determined for each of the first indoor unit and the second indoor unit, and information on an indoor unit whose interlock is not released of the first indoor unit and the second indoor unit, where the information further indicates whether or not the safety device is necessary, is output.

11. The installation assistance system for the air conditioning device according to claim 6, wherein a necessity of providing the safety device is determined for each of the first indoor unit and the second indoor unit, and information on an indoor unit whose interlock is not released of the first indoor unit and the second indoor unit, where the information further indicates whether or not the safety device is necessary, is output.

12. The installation assistance system for the air conditioning device according to claim 7, wherein information including floor areas of indoor spaces in which the first indoor unit and the second indoor unit are installed, an amount of refrigerant used in the air conditioning device, and lengths of pipes connected to the first indoor unit and the second indoor unit is acquired, and based on the acquired information, the necessity of providing the safety device is determined for the first indoor unit and the second indoor unit.

13. An installation assistance device for an air conditioning device including a first indoor unit and a second indoor unit interlocking with a safety device as a countermeasure against refrigerant leakage, the installation assistance device comprising:

a storage unit that stores information on the air conditioning device, the storage unit including a memory;

a determination unit configured to determine interlock release states of the first indoor unit and the second indoor unit based on the information on the air conditioning device in the storage unit, the determination unit including a processor; and an output unit configured to output a determination result of the determination unit, the output unit including a display, the information on the air conditioning device being information indicating whether or not the first indoor unit and the second indoor unit are short-circuited with the safety device through an interlock line.

14. The installation assistance device for the air conditioning device according to claim 13, wherein the output unit includes a display unit that displays the determination result to a user.

15. An installation assistance method for an air conditioning device including a first indoor unit and a second indoor unit interlocking with a safety device as countermeasures against refrigerant leakage, the installation assistance method comprising:

determining interlock release states of the first indoor unit and the second indoor unit based on information on the air conditioning device, and outputting a determination result, the information on the air conditioning device being information indicating whether or not the first indoor unit and the second indoor unit are short-circuited with the safety device through an interlock line.

* * * * *